US010856587B2

(12) United States Patent
Standard et al.

(10) Patent No.: US 10,856,587 B2
(45) Date of Patent: Dec. 8, 2020

(54) SURVIVAL, EVACUATION, RESCUE, AND RECOVERY VEST DEVICE

(71) Applicants: Mark T. Standard, Silver Spring, MD (US); Tamika K. Standard, Silver Spring, MD (US)

(72) Inventors: Mark T. Standard, Silver Spring, MD (US); Tamika K. Standard, Silver Spring, MD (US)

( * ) Notice: Subject to any disclaimer, the term of this patent is extended or adjusted under 35 U.S.C. 154(b) by 226 days.

(21) Appl. No.: 15/135,454

(22) Filed: Apr. 21, 2016

(65) Prior Publication Data

US 2016/0309802 A1 Oct. 27, 2016

Related U.S. Application Data

(60) Provisional application No. 62/150,806, filed on Apr. 21, 2015.

(51) Int. Cl.

| | |
|---|---|
| ***A41D 1/00*** | (2018.01) |
| ***A41D 13/00*** | (2006.01) |
| ***A41D 13/01*** | (2006.01) |
| ***G08B 5/00*** | (2006.01) |

(52) U.S. Cl.

CPC ..... *A41D 1/002* (2013.01); *A41D 13/0012* (2013.01); *A41D 13/01* (2013.01); *G08B 5/004* (2013.01)

(58) Field of Classification Search

CPC .... A41D 1/002; A41D 13/0012; A41D 13/01; A41D 13/0125; A41D 15/04; A41D 1/005; A41D 1/04; A41D 27/201; A41D 27/205; A41D 27/208; A41D 31/0088; A41D 2400/46; G08B 5/004

USPC ..... 2/102, 94, 247

See application file for complete search history.

(56) References Cited

U.S. PATENT DOCUMENTS

| | | | | |
|---|---|---|---|---|
| 2,066,072 A * | 12/1936 | Powell | A41D 13/0012 | 2/51 |
| 2,911,649 A * | 11/1959 | Ruelle | A41D 13/0125 | 2/69.5 |
| 3,529,307 A * | 9/1970 | Belson | A41D 13/0012 | 2/94 |
| 4,041,549 A * | 8/1977 | Atkinson | A41D 13/0012 | 139/391 |

(Continued)

OTHER PUBLICATIONS

"Customizing the Sunny Day Shorts: Hexagon Pockets," written by Rachel Le Grand, dated Jun. 23, 2014 and retrieved at https://oliverands.com/community/blog/2014/06/customizing-the-sunny-day-shorts-hexagon-pockets.html on May 1, 2019.*

*Primary Examiner* — Jameson D Collier
*Assistant Examiner* — F Griffin Hall
(74) *Attorney, Agent, or Firm* — Michael L. Greenberg, Esq.; Greenberg & Lieberman, LLC

(57) ABSTRACT

An evacuation, rescue, and survival vest device is described. The vest is configured with hexagonal or honey-comb-shaped compartments having multiple access points across the surface area of the vest. The vest device is a garment composed of a lightweight, buoyant, reflective material. At least one light is disposed near the top of the vest to illuminate the wearer making him or her more visible, as well as to illuminate the wearer's sight at night. Compartments disclosed on the interior of the garment are also available. Rear compartments disposed on the back of the garment provide for the storage of water, hydration equipment, and rations.

7 Claims, 5 Drawing Sheets

(56) References Cited

U.S. PATENT DOCUMENTS 4,106,121 A * 8/1978 Belson ..... A41D 13/0012 2/102
4,137,586 A * 2/1979 Evert ..... B63C 9/093 441/107
4,416,641 A * 11/1983 Spinosa ..... A41D 13/0125 441/107
4,475,251 A * 10/1984 Hopkins ..... A45C 9/00 2/85
4,637,075 A * 1/1987 Ingrisano ..... A41D 13/0012 2/102
4,703,521 A * 11/1987 Asher ..... A41D 15/04 135/95
4,932,910 A * 6/1990 Hayday ..... B63C 9/21 441/11
4,953,765 A * 9/1990 Little ..... A41D 13/0012 206/373
5,014,359 A * 5/1991 Hanson ..... A41D 13/0012 2/102
5,024,360 A * 6/1991 Rodriguez ..... A41D 13/0012 2/102
5,063,614 A * 11/1991 McSheffery ..... A41D 15/005 2/102
5,075,900 A * 12/1991 Chittenden ..... A41D 13/0012 2/102
5,101,515 A * 4/1992 Holt ..... A41D 13/0051 2/102
5,195,187 A * 3/1993 Yang ..... A41D 13/0012 2/102
5,211,321 A * 5/1993 Rodriguez ..... A41D 13/0012 2/102
5,247,707 A * 9/1993 Parker ..... A41D 13/0012 2/102
5,278,998 A * 1/1994 Book ..... A41D 13/0012 190/1
5,361,412 A * 11/1994 Perry ..... A41D 13/0012 2/102
5,592,691 A * 1/1997 Ronald ..... A41D 15/00 2/243.1
5,603,646 A * 2/1997 Tobias ..... A41D 13/0125 441/106
5,603,648 A * 2/1997 Kea ..... B63C 9/1255 441/106
5,673,836 A * 10/1997 Bush ..... A41D 13/00 2/94
5,855,454 A * 1/1999 Courtney ..... B63C 9/1055 405/186
5,909,802 A * 6/1999 Puco ..... A45F 3/04 2/102
5,991,925 A * 11/1999 Wu ..... A41D 13/0012 2/102
6,029,270 A * 2/2000 Ost ..... A41D 3/00 2/2.5
6,106,130 A * 8/2000 Harding ..... A41D 13/01 362/103
6,108,816 A * 8/2000 Bradley ..... B63C 9/11 182/3
6,233,740 B1 * 5/2001 Meyers ..... A41D 13/0007 2/102
6,314,579 B1 * 11/2001 Marcon ..... A41D 13/0012 2/102
6,421,834 B2 * 7/2002 Kester ..... A41D 15/04 2/94
6,763,527 B1 * 7/2004 Rivoli ..... A41D 13/0012 2/250
6,820,281 B2 * 11/2004 Mariland ..... A41D 27/20 2/115
6,968,574 B2 * 11/2005 Kroll ..... A41D 13/0125 2/410
7,065,792 B2 * 6/2006 Hautala ..... A41D 13/0012 2/69
7,195,369 B2 * 3/2007 Shaw ..... A41D 13/01 340/573.6
7,841,344 B2 * 11/2010 Schlosser ..... A41D 13/018 128/205.22
8,032,951 B1 * 10/2011 Nestberg ..... A41D 13/0012 2/247
8,793,815 B1 * 8/2014 Kelley-Mozsy ..... A41D 27/20 2/247
8,845,375 B2 * 9/2014 Lee ..... A41D 13/0025 441/105
9,381,982 B1 * 7/2016 Sumpter ..... B63C 9/20
2001/0052532 A1 * 12/2001 Perez ..... A41D 13/0012 224/575
2004/0157514 A1 * 8/2004 Courtney ..... B63C 9/081 441/88
2005/0120464 A1 * 6/2005 Clark ..... A41D 13/0012 2/247
2005/0188450 A1 * 9/2005 Clark ..... A41D 13/0012 2/247
2006/0143775 A1 * 7/2006 Kim ..... A41D 1/005 2/102
2006/0288466 A1 * 12/2006 Bucheit ..... A41D 13/0012 2/102
2007/0291473 A1 * 12/2007 Traynor ..... A01K 11/00 362/106
2008/0067202 A1 * 3/2008 Silva ..... A41D 13/01 224/148.2
2009/0031467 A1 * 2/2009 Swindells ..... A41D 13/0012 2/51
2009/0151040 A1 * 6/2009 Lee-Johnson ..... A41D 13/0012 2/51
2011/0083248 A1 * 4/2011 Johson ..... A41D 13/0012 2/102
2011/0099682 A1 * 5/2011 Earley ..... A41D 13/0012 2/115
2012/0272431 A1 * 11/2012 Kupinic ..... A41D 1/002 2/129
2012/0291179 A1 * 11/2012 Shea ..... A41D 27/20 2/102
2013/0167286 A1 * 7/2013 Hudson ..... A41D 1/04 2/102
2014/0022766 A1 * 1/2014 Wright ..... A41D 13/01 362/108
2014/0183231 A1 * 7/2014 Nouri ..... A45F 3/04 224/148.2
2014/0231277 A1 * 8/2014 Ponski ..... A45C 11/00 206/38
2014/0285355 A1 * 9/2014 Matte ..... G08B 5/36 340/815.45
2017/0202275 A1 * 7/2017 St. John ..... A41D 27/10
2017/0245567 A1 * 8/2017 Fathollahi ..... H02J 7/0042

* cited by examiner

SURVIVAL, EVACUATION, RESCUE, AND RECOVERY VEST DEVICE

CONTINUITY

This application is a non-provisional patent application of provisional patent application No. 62/150,806, filed on Apr. 21, 2015, and priority is claimed thereto.

FIELD OF THE PRESENT INVENTION

The present invention relates to survival tools and elements, and more specifically relates to a wearable garment device that facilitates the safe evacuation, survival, rescue, and recovery of an individual in a disaster or emergency situation.

BACKGROUND OF THE PRESENT INVENTION

In disaster situations, immediate access to emergency devices and supplies in a portable format is critical to survival. Common emergency devices are primarily focused on three basic components: rescue, first aid, and survival. Rapid evacuation is seldom addressed in the design of emergency devices. Quick and easy movement is essential to escaping dire situations, including simple house fires, black smoke, toxic gas leaks, floods and other catastrophic events. Unfortunately, 60% of people have made no preparations for when a disaster strikes, even though they believe that they are at risk.

Regardless of the variety of emergency that strikes, many experts warn that it may take up to 72 hours for victims to get the assistance they need. It is conventionally known that a disaster preparedness kit should be crafted for use by all individuals to include everything a person needs to survive for 72 hours. It must also be lightweight and portable enough for the user to evacuate his or her home, and temporarily live outside.

The abruptness of many emergencies often poses a problem for many emergency preparedness equipment kits. Since many emergencies often appear suddenly and without warning, many people are caught in an unprepared state. Seldom is there consideration given to the suddenness of an emergency, and the proximity of the emergency device or kit. Increasingly, the public have developed plans and are equipped with "bug-out" bags in their homes in preparation for the worst. The vulnerable areas include locales away from the home, such as work, in the car, on vacation, in school, and during travel. With a short timeframe from alarm to action, the overall accessibility of the emergency device is critical to the usefulness of the device.

Unfortunately, these devices are often stowed away from the individual, forcing them to find the device and/or supplies in a hurried fashion for the device to be of any use. Some survival tools are configured to be worn on the body. Wearable survival or emergency preparedness garments are most commonly found in the form of vests. Many of these vests have been developed and designed for a specific purpose, instead of a general survival or emergency nature. There are survival vests for aviation, hunting, and weaponry. These vests commonly include bulky outside pockets, straps and other attaching devices for food supplies, first aid items, signaling devices and other survival apparatus. These vests are not designed to be worn by an untrained ordinary civilian who is challenged with escaping from an emergency such as a building fire. Additionally, wearable survival or emergency preparedness garments are seldom composed of materials that sufficiently address a wide range of conditions or circumstances. A universal emergency garment, therefore, must endure numerous stresses including pulls, tears, cold, heat, fire, water, and impact.

In some emergency situations, individuals have ample notice to evacuate. However, in many emergency situations such as building fires, toxic gas leaks, terrorist attacks, infectious disease exposure, tornadoes, tsunamis, earthquakes and explosions, there is very little time to prepare for evacuation. In these circumstances, it is vital to be able to move and travel over an extended distance for a prolonged period of time. Experts recommend in an emergency situation that people should be prepared to survive for 72-hours before rescue. However, even those that are prepared, and have a remotely accessible emergency kit often forget to provide a means for recovery after a catastrophe. Therefore, vital life data and documents are often lost or destroyed, especially in cases of flood or fire. Without critical financial and insurance data, the return to any semblance of a normal life is commonly delayed for many disaster-stricken individuals.

Thus, there is a need for an emergency garment configured to expedite the safe evacuation, rescue, and recovery process of the wearer such that loss of life is minimized, and the reintegration to society are expedited.

SUMMARY OF THE PRESENT INVENTION

The present invention is a wearable personal evacuation garment device specially equipped with essential items providing for mobility, survivability, high visibility and recoverability of the user. The essential items are equipped within the garment in a unique hexagonal compartment integrated into the structure of the garment that allows the garment to be easily folded, remain functional while occupying little space, and eliminate the bulkiness of traditional utility vests. The essential capabilities of the garment of the present invention include weather-proofing and compartments for evacuation, survival, rescue, and recovery elements for an individual.

Having a broad range of supplies and devices is critical to survive and recover. Essential items and attributes of the garment of the present invention include;

Lightweight for mobility
Easy fit for wearability
Ease of use
Waterproof technology
High visibility design
Hazardous-Materials compartment
Nutrition compartment
First aid compartment
Personal Medication compartment
Signaling compartment
Hydration compartment
Navigation capability
Shelter compartment
Floatation capability Each of the compartments of the present invention is configured to maximize the utility of the garment during evacuation, survival, rescue and recovery.

In order to facilitate safe and expedient evacuation of an individual in an emergency or dangerous situation, the present invention is equipped with multiple compartments to provide the wearer easy access to a variety of supply elements. These elements, made comfortable and accessible by the design of the present invention, can expedite the evacuation process, increase the chances of survival after a catastrophic event, and facilitate the rescue of the wearer by increasing his or her visibility during night and day.

For example, easily accessible supply elements, such as ventilation masks or gas masks, can be critical to successfully evacuate from emergency situations such as fire, black smoke, toxic gas, volcanic eruption, or an explosion. Supply elements such as these are preferably housed in a hazardous materials compartment on the garment of the present invention. The present invention is preferably light weight, durable, and fire resistant with easy access to supply elements. In order to increase the chance of survival immediately following a disastrous event such as an explosion, building collapse, shooting, landslide, flood, tsunami, or earthquake, the present invention is equipped with floatation and water proof capabilities while supplying easy access to the supply elements.

Additionally, the present invention is equipped with rescue elements including devices and supplies designed to assist in the rescue operation, facilitating visibility of the wearer, and providing a communication medium to facilitate the rescue of the wearer. Thus, the material of the garment of the present invention is preferably highly reflective, and is of a bright color. Additionally, at least one light mechanism is disposed on the present invention, and is configured to illuminate the wearer, making him or her easier to view for rescue. An additional lighting mechanism directs light in front of the wearer, facilitating hands-free navigation in the dark.

As the present invention is designed for use by ordinary, untrained individuals, each compartment and packet therein are lightweight and slim fit. Packets for the compartments of the present invention may be pre-packaged, such that individuals may purchase replacement packets for each compartment in the event that the individual uses the supplies, the supplies are damaged, or they become expired. The present invention is configured to require minimal effort for the individual to have a sound escape or evacuation plan, complete with requisite supplies ready at-hand at a moment's notice.

BRIEF DESCRIPTION OF THE DRAWINGS

The present invention will be better understood with reference to the appended drawing sheets, wherein.

DETAILED DESCRIPTION OF THE PREFERRED EMBODIMENT

Figure 2:
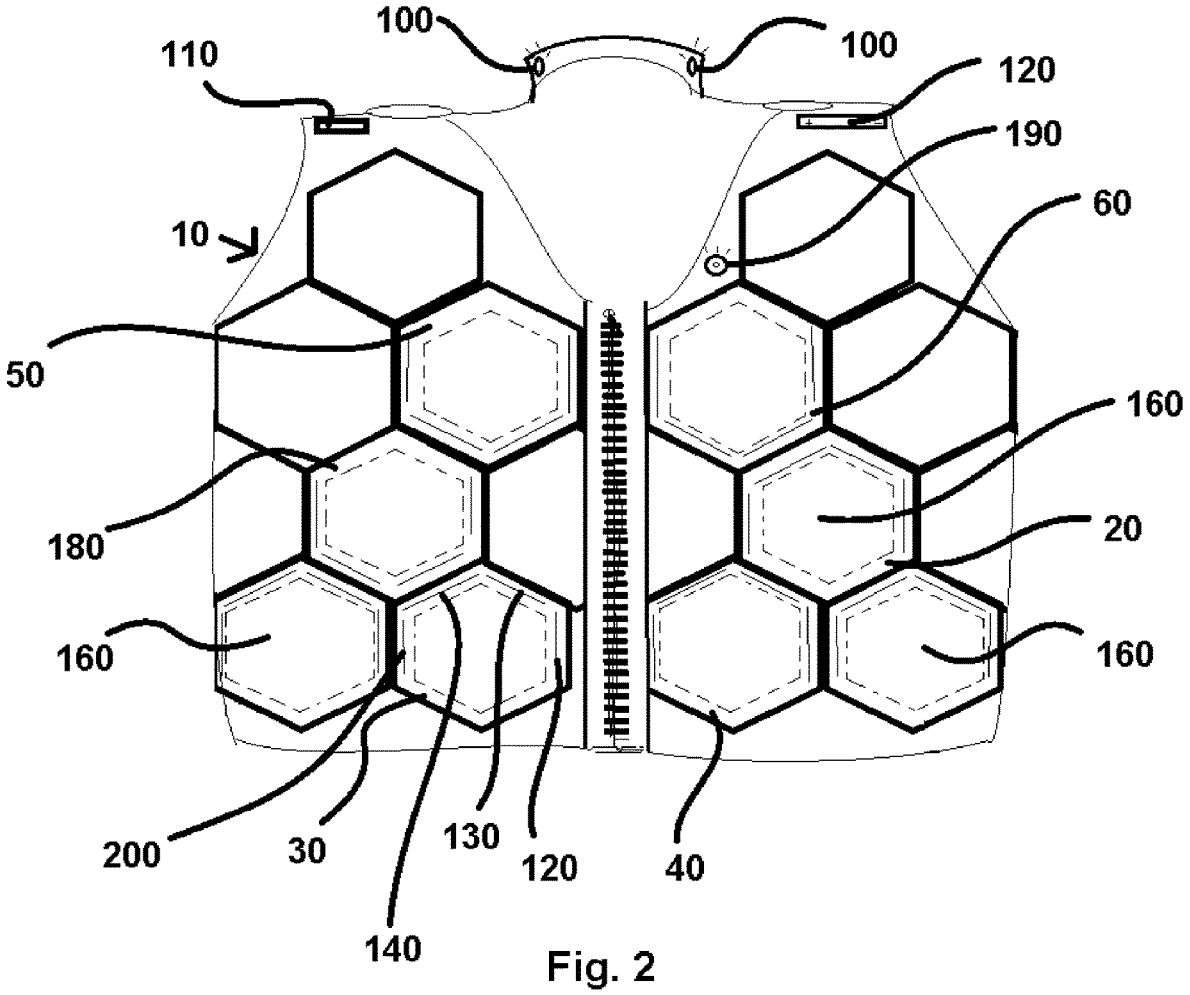
FIG. 2 exhibits a complete view of the garment of the present invention as seen from the front, displaying an alternate embodiment of the present invention detailing alternate placement of each compartment.
Figure 4:
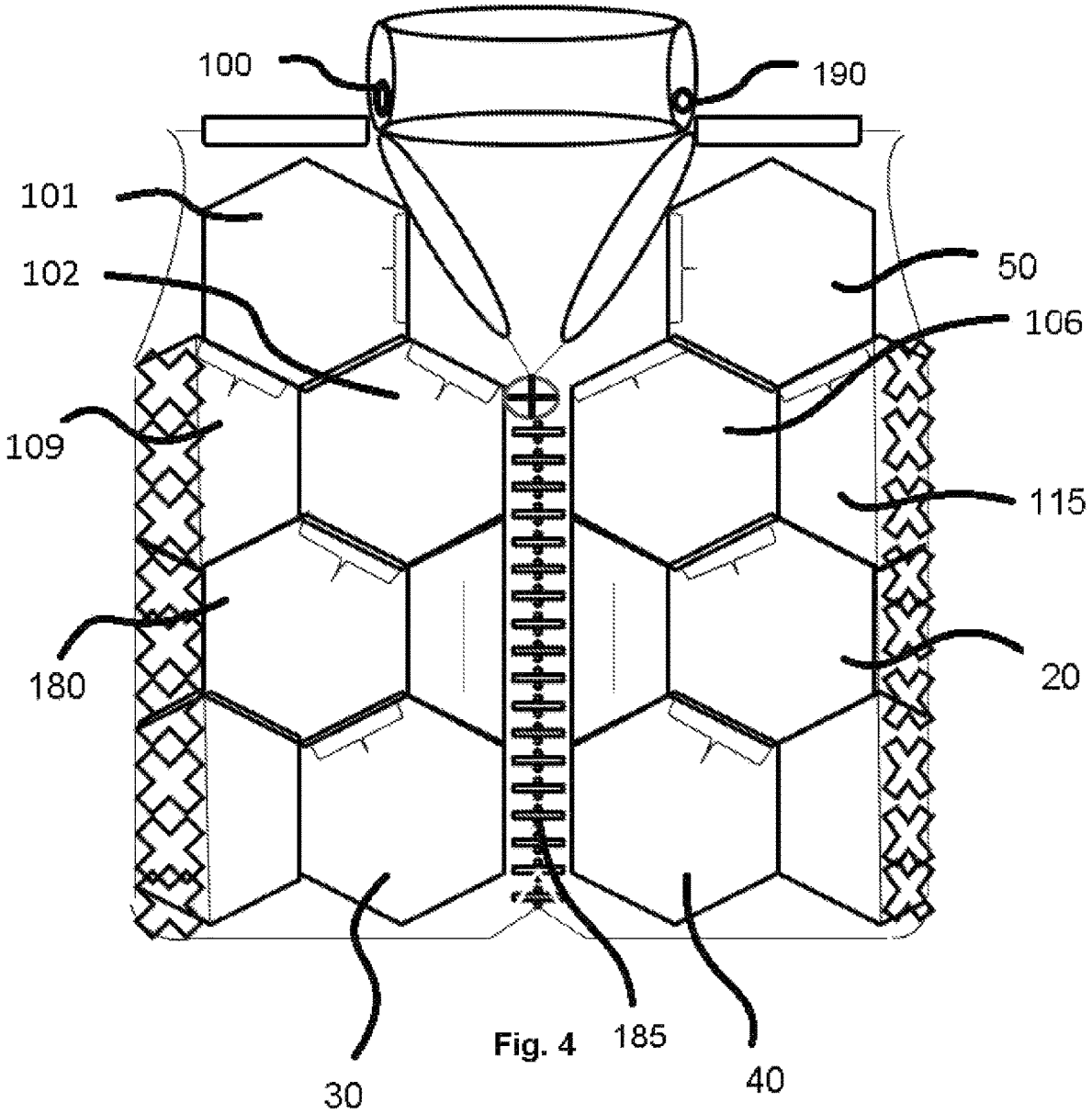
FIG. 4 shows a more detailed view of the preferred embodiment of the present invention as seen from the front.

The present invention generally comprises a garment (10), as seen in FIG. 2 and FIG. 4, preferably fashioned of a lightweight, breathable material, equipped with numerous compartments (150). Each compartment (150) is preferably tailored to accommodate specific survival and emergency gear. For example, the preferred embodiment of the present invention is preferably equipped with a nutrition compartment (20), a first aid compartment (30), a personal medication compartment (40), a signaling compartment (50), a hydration compartment (60) preferably disposed on the rear of the garment (10), a recovery compartment (70) disposed on the interior of the garment (10), a shelter compartment (80) containing string also disposed on the rear of the garment (10), and a hazardous materials compartment (180). Some embodiments of the present invention are also outfitted with an identification compartment (101), a flashlight compartment (102), a cell phone compartment (109) and a two-way radio compartment (115).

Figure 5:
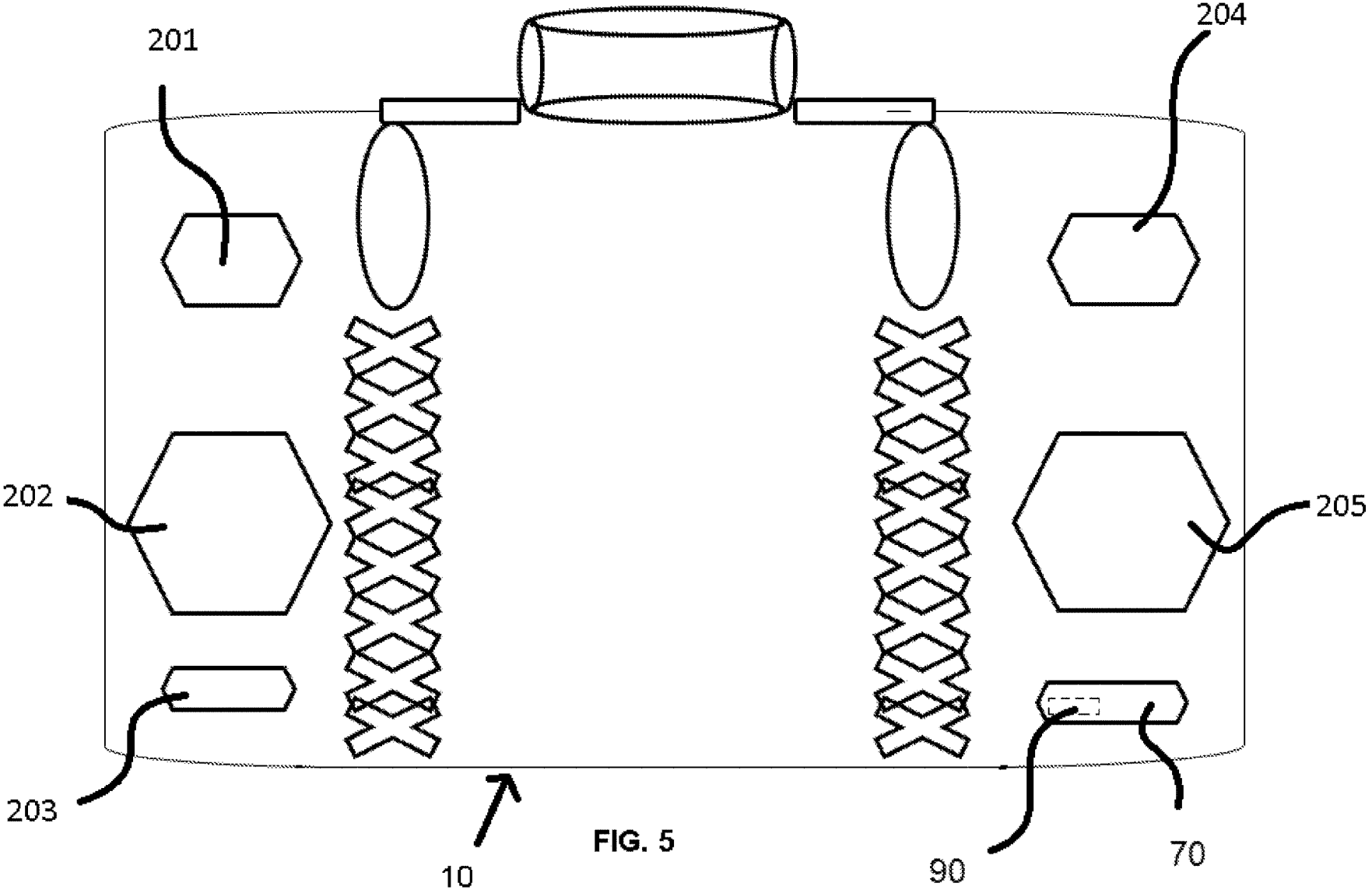
FIG. 5 details the interior of the garment of the present invention, showing interior compartments.

The interior of the garment (10) preferably includes a cash compartment (201), an essential documents compartment (202), a keys compartment (203), a cards compartment (204), a maps compartment (205), and a recovery compartment (70), as shown in FIG. 5. It should be understood that the flashlight compartment (102) contains a flashlight, the cash compartment (201) contains cash, the maps compartment (205) contains maps, the essential documents compartment (202) contains essential documents, and the two-way radio compartment (115) contains a two-way radio.

Figure 1:
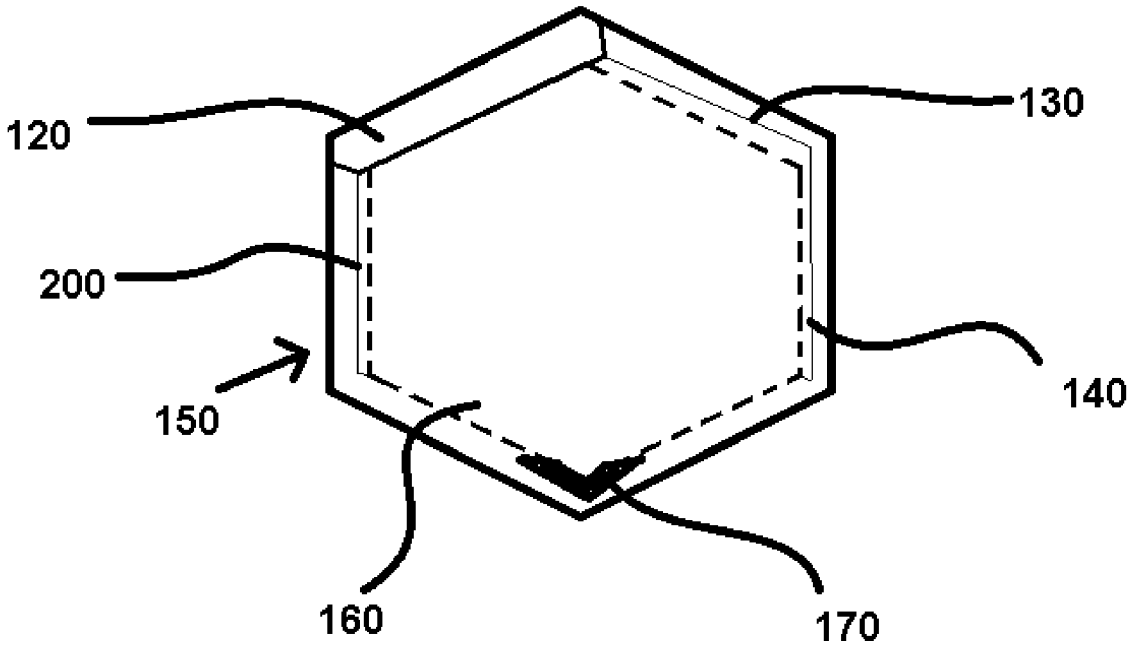
FIG. 1 displays a close-up view of a packet of the present invention, disposed within a compartment.

Each compartment (150) is preferably equipped with a packet (160) containing supply and survival elements critical to the survival, rescue, and recovery of the wearer which may be easily removed from the compartment. Each compartment (150) and corresponding packet (160) are preferably hexagonally shaped, as seen in FIG. 1. Additionally, each compartment is preferably accessible from multiple sides of the hexagon. It should be understood that there is only one compartment (150) per hexagon. Some embodiments of the present invention feature multiple sides of each compartment (150) that serve as openings to the compartment (150). In all embodiments of the present invention, the opening of each compartment (150) is disposed such that it is easily accessible and proximal to the hands of the user. Openings of the compartments (150) are preferably disposed closest to the mid-section of the user; however, compartments (150) disposed toward the bottom of the garment (10) have openings oriented toward the user's hands.

In some embodiments of the present invention, four of the six sides of the hexagon serve as access points, featuring a Velcro™, snap, or similar temporary sealing mechanism over an opening providing access to the packet (160). In the preferred embodiment of the present invention, only one of the four access points are configured to open—the opening location corresponding with the optimal placement of the opening according to the accessibility of the access point in proximity to the nearest hand of the user. In some alternate embodiments of the present invention, multiple openings to each compartment facilitate rapid access to the contents of each compartment (150). As such, each compartment (150) is equipped with a first opening (120), a second opening (130), a third opening (140), and a fourth opening (200) in some embodiments of the present invention. The two remaining sides of the compartment are not equipped with an opening, and are preferably disposed such that the two remaining sides are pointed away from the hands of the user. Each compartment is configured to house a packet (160) which is preferably pre-sealed, and of similar shape and size as the compartment. A lock-in mechanism (170) is preferably disposed on the interior of the pocket, providing a means to secure the packet (160) within the compartment (150) when not in use.

The garment (10) of the present invention is preferably fashioned of a reflective material that allows the wearer to be easily seen from a distance, from the air, in the dark, and underwater. The garment (10) is preferably equipped with a zipper (185) or similar conventional securing mechanism such as a button, snaps, or hook-and-loop type fastener. Additionally, the present invention is equipped with a first collar light mechanism (100) adding to the visibility of the wearer at night, and is configured to illuminate 180 degrees around the user when the garment (10) is worn. A second collar light mechanism (190) is similarly disposed on or near the collar of the garment (10); however, it is configured to cast a beam of light ahead of the wearer, facilitating safe, hands-free navigation in the dark. It is envisioned that the first collar light mechanism (190) and the second collar light mechanism (190) may be equipped with multiple light bulbs, and preferably employ LED bulbs to require minimal power to illuminate. The first collar light mechanism (100) and the second collar light mechanism (190) are preferably powered by an internal waterproofed battery housed within an illumination battery compartment (106), and may be equipped with a solar charger.

Similarly, the present invention is configured to float when submerged in water, as it is preferably equipped with flotation material in all portions of the garment (10) that are not hexagon-shaped, as well as on the rear of the garment (10), helping to prevent the wearer from drowning in flood or other water-based emergencies. In order to facilitate and expedite the rescue of the wearer, the present invention is preferably equipped with a GPS tracking device (110), allowing the location of the garment (10) and user to be easily tracked. Likewise, the present invention is lightweight in order to facilitate the comfortable transport of supply, recovery, and survival elements.

Recovery from a crisis or emergency scenario is personal and specific to each individual. After a disaster or similar emergency circumstance, the recovery elements of the wearable device of the present invention preferably allow for the individual to recover and restart their life anew. This necessitates prior data, proof of identity, financial information, etc. The recovery compartment (70) is therefore a very important component of the present invention, as it pertains to the weather-proofed location to dispose vital documents and/or data. To recover from a disaster or emergency, access to data is essential to re-establish links, acquire goods and services such as insurance, medical history or financial assets. Compartments containing these items are preferably located on the interior of the garment (10) of the present invention as seen in FIG. 5.

It is envisioned that the recovery compartment (70) of the present invention is equipped with memory (90), preferably as a water-proofed memory drive, USB compatible flash memory drive, or a sub-pocket for disposing a conventional portable memory device. Such a device housed within the recovery compartment (70) of the present invention enables the user to preload the memory (90) with vital life data pertaining to items including, but not limited to medical records, employment records, tax records, insurance information, identity information, proof of birth location, and other vital documents and data. The goal of the recovery compartment (70) is to include—and to save from disaster—valuable photos, documents, passports, spare keys, identification, and other essentials to lessen the loss in the event of a large fire, explosion, flood, or other event capable of destroying one's home, history, and belongings.

Figure 3:
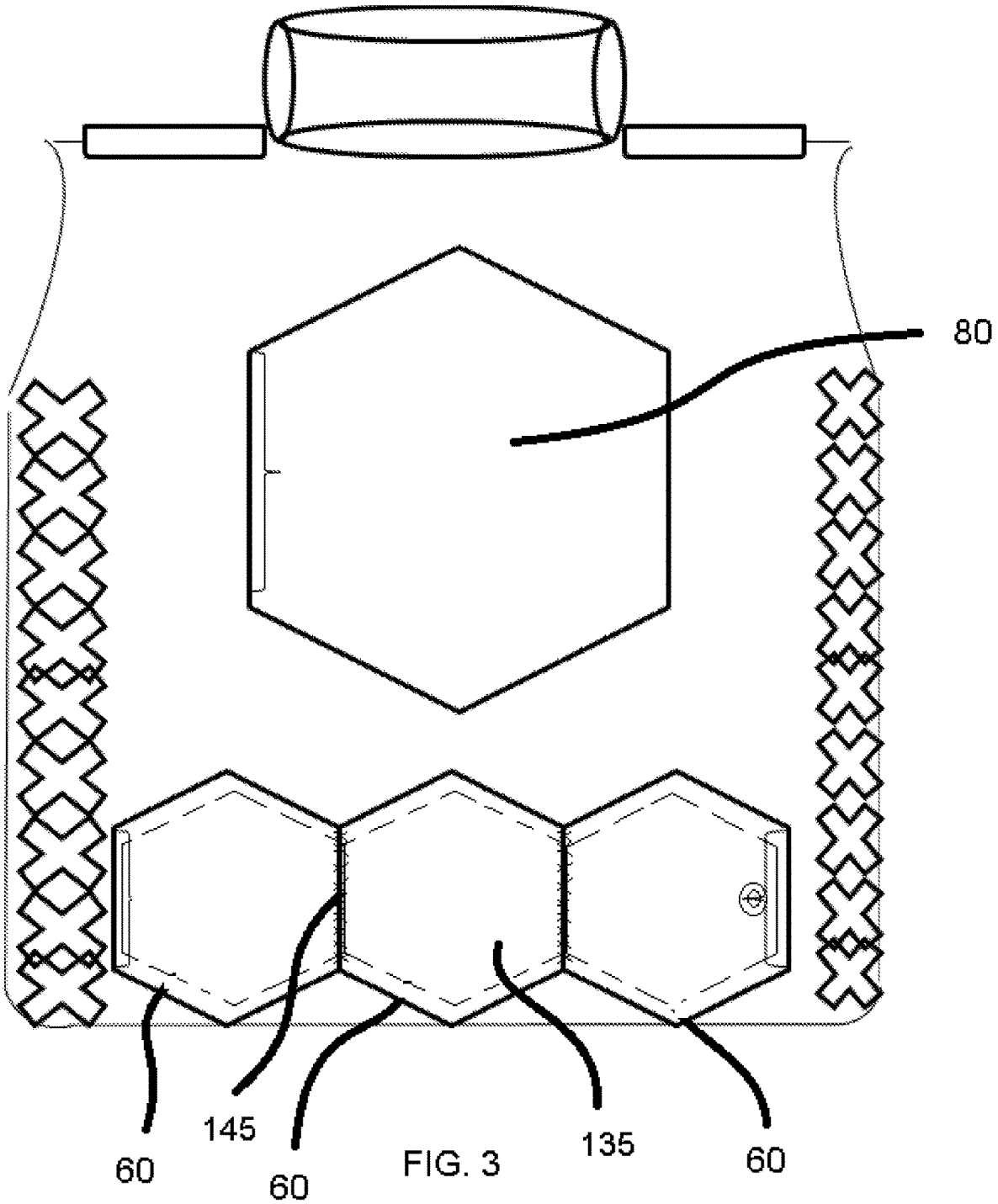
FIG. 3 is a view of the rear of the preferred embodiment of the present invention.

The hydration compartment (60) of the present invention, located on the rear of the garment (10) of the present invention as shown in FIG. 3, is preferably equipped with a bladder packet (135) that is positioned on the rear of the garment (10), at the small of the back, so as to remain non-obtrusive in a horizontal position. The bladder packet (135) is configured to slide within the hydration compartment (60), and is preferably equipped with a drinking tube configured to extend to the front of the garment (10) to facilitate drinking from the hydration compartment (60). Conversely, some embodiments of the present invention may include water bottles made of lightweight material to be housed within the hydration compartment (60). Additionally, the bladder packet (135) of the hydration compartment (60), preferably a water-sealed acrylic or plastic bladder, may contain electrolyte-based powders or vitamins to provide additional sustenance for the user to be consumed when mixed with water.

Additionally, the hydration compartment (60) of the present invention preferably consists of three sections as shown in FIG. 3; however, it is envisioned that the bladder packet (135) is unitary, and extends across all three sections horizontally, shown as dotted lines. An elastic seam (145) is disposed between the sections comprising the hydration compartment (60). The elastic of the elastic seam (145) serves to exert pressure on the bladder packet (135), helping to ensure that the liquid encased in the bladder packet (135) is slightly pressurized to facilitate drinking.

The first aid compartment (30) preferably contains a packet (160) containing conventional first aid equipment including, but not limited to iodine, adhesive bandages, antiseptic, swabs, wraps, aspirin, and other similar medical supplies.

Additionally, the nutrition compartment (20) of the present invention houses a packet containing a variety of nutritional supplies including, but not limited to MREs, rations, dehydrated foods, vitamins, and other non-perishable foodstuffs. The personal medication compartment (40) of the present invention is configured to house any and all medications that the wearer foresees needing for 72 hours or more. The waterproofed personal medication compartment (40) helps to save the lives of those that require medications to live or remain healthy, as well as the elderly. Finally, the signaling compartment (50) is equipped with a packet (160) containing various signaling equipment, including but not limited to, a signal mirror, a light, a whistle, a flare, a flint stone, and other similar signaling gear.

Alternate embodiments of the garment of the present invention may include variations on the content of each packet, as well as the placement of each compartment in relation to other compartments. For example, some embodiments may have all compartments (150) for sustenance, namely the nutrition compartment (20), hydration compartment (60), integrated in a single pocket, or dispersed across the garment (10) with each compartment containing sustenance elements.

It should be noted that the garment (10) of the present invention is buoyant, and may be configured with elongated, inflatable flotation devices disposed atop the shoulders of the garment (10). The flotation devices are configured to ensure that the head of the user remains above water in the event that the emergency is water-related. However, in alternate embodiments of the present invention, foam or air-based floatation material may be disposed within the lining of the garment (10), disposed in areas not equipped with a compartment.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. An emergency survival apparatus comprising:

a garment, said garment having a front;

wherein said garment has a back;

a first collar light mechanism;

a second collar light mechanism;

a power source;

a GPS tracking device;

a portable memory device;

wherein said power source is configured to power said GPS tracking device, said first collar light mechanism, and said second collar light mechanism;

compartments;

wherein said compartments are shaped as hexagons;

a first opening, said first opening disposed on a first of the six sides of each said of compartments;

a second opening, said second opening disposed on a second of the six sides of each said of compartments;

a third opening, said third opening disposed on a third of the six sides of each said of compartments;

a fourth opening, said fourth opening disposed on a fourth of the six sides of each said of compartments;

wherein said first opening, said second opening, said third opening, and said fourth opening are temporarily sealed via a hook-and-loop fastener; and wherein said portable memory device is contained in an iteration of said compartments which is located on the interior of said garment.

2. The apparatus of claim 1, wherein said power source is a rechargeable battery; and wherein said garment is made of reflective fabric.

3. The apparatus of claim 2, further comprising:

wherein said portable memory device is a USB flash drive;

wherein said portable memory device is waterproof; and wherein said portable memory device contains vital life data.

4. The apparatus of claim 3, wherein said vital life data includes: medical records, employment records, tax records, insurance information, identity information, and digital photos.

5. The apparatus of claim 1, wherein said first collar light mechanism is oriented to cast light in 180 degrees; and wherein said second collar light mechanism is configured to cast light in front and away from said front of said garment.

6. The apparatus of claim 1, wherein said garment is a vest.

7. The apparatus of claim 1, wherein said first collar light mechanism is waterproof; and wherein said second collar light mechanism is waterproof.

* * * * *